United States Patent [19]

Kawaguchi

[11] Patent Number: 4,479,731

[45] Date of Patent: Oct. 30, 1984

[54] SERIAL PRINTER CARRIAGE MOUNTING

[75] Inventor: Katsuhiko Kawaguchi, Tagata, Japan

[73] Assignee: Tokyo Electric Co., Ltd., Tokyo, Japan

[21] Appl. No.: 508,912

[22] Filed: Jun. 29, 1983

[30] Foreign Application Priority Data

Jun. 30, 1982 [JP] Japan ..... 57-114313

[51] Int. Cl.[3] ..... B41J 25/28

[52] U.S. Cl. ..... 400/320; 400/335; 400/357

[58] Field of Search ..... 400/320, 322, 323, 328, 400/335, 352, 357; 74/89.2, 89.21, 89.22

[56] References Cited

U.S. PATENT DOCUMENTS

| | | | |
|---|---|---|---|
| 674,071 | 5/1901 | Anderson | 74/89.22 |
| 2,847,859 | 8/1958 | Lynott | 400/335 X |
| 4,203,680 | 5/1980 | Mitrovich | 400/322 X |
| 4,376,586 | 3/1983 | Fujisawa | 400/320 X |

FOREIGN PATENT DOCUMENTS

| | | | |
|---|---|---|---|
| 0020977 | 1/1981 | European Pat. Off. | 400/352 |

OTHER PUBLICATIONS

Xerox Disclosure Journal, "Carriage Design to Eliminate Left Cables", by Kockler, vol. 4, No. 2, Mar., Apr. 79, p. 179.

*Primary Examiner*—Edgar S. Burr
*Assistant Examiner*—John A. Weresh
*Attorney, Agent, or Firm*—Oblon, Fisher, Spivak, McClelland & Maier

[57] ABSTRACT

The present invention discloses a serial printer for reciprocating a carrier along a platen by means of a wire, wherein the wire is connected to a wire retainer, which is a member separated from the carrier, to form a wire route, the carrier being detachably mounted on the wire retainer whereby the carrier may be removed with the wire remained stretched. Maintenance, checking and repair are easily accomplished and initial assembling is accomplished in a very simple manner.

5 Claims, 7 Drawing Figures

SERIAL PRINTER CARRIAGE MOUNTING

FIELD OF THE INVENTION

The present invention relates to a serial printer for effecting printing while moving a carrier with a printing head loaded thereon along a platen, for example, such as a wire dot printer or a thermal printer.

OBJECTS OF THE INVENTION

It is a first object of the present invention to provide a serial printer which can be assembled very easily.

It is a second object of the present invention to provide a serial printer for which maintenance, checking and repair can be easily accomplished.

It is a third object of the present invention to provide a serial printer in which even if the carrier is removed, stretching of a wire may be maintained in a stable condition.

DESCRIPTION OF THE PRIOR ART

Figure 1:
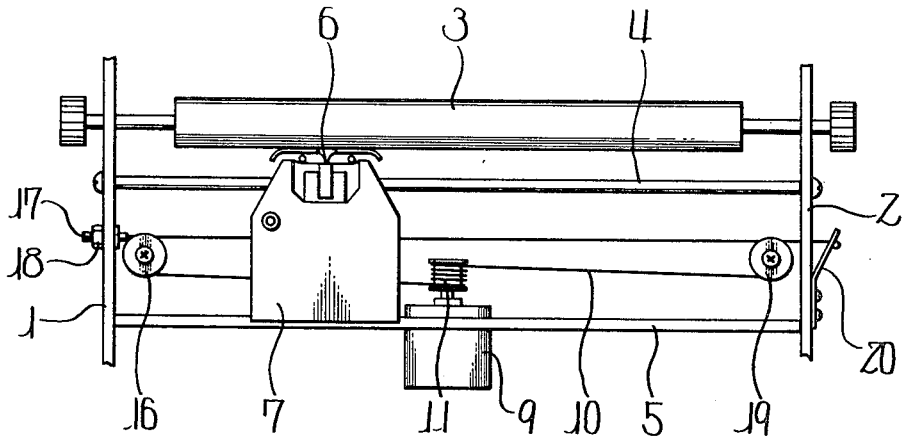
FIG. 1 is a plan view in a reduced scale showing a first embodiment of the present invention.
Figure 2:
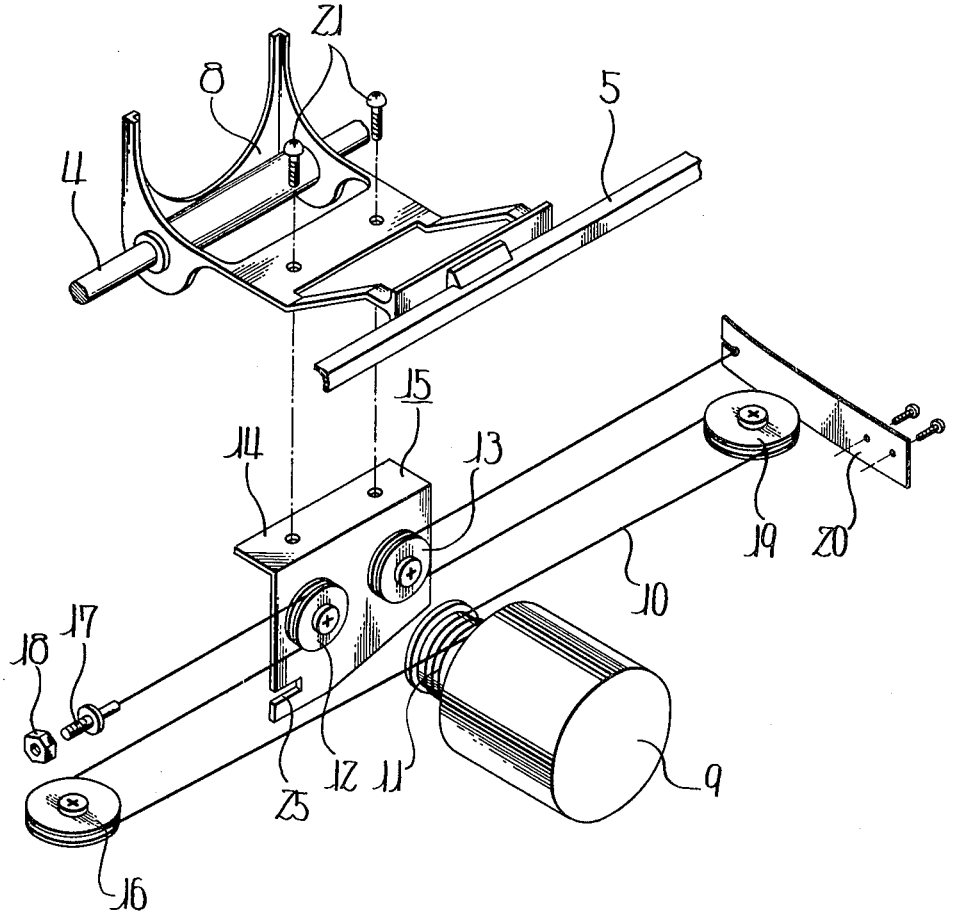
FIG. 2 is an exploded perspective view of an essential portion of the same.

In the past, in order that a carrier with a printing head loaded thereon may be driven by means of a wire, the wire is connected to the carrier and the wire is wound about a winding drum connected to a motor which is normally and reversely rotated. Therefore, when the wire is stretched, the relatively large carrier is a hindrance and the operability therefor is poor and the assembling operation is difficult to be accomplished. Also, in maintainance, the carrier has to be removed but the wire has also to be removed to remove the carrier. Overhauling operation is cumbersome and reassembling is difficult.

DESCRIPTION OF THE PREFERRED EMBODIMENTS

A first embodiment of the present invention will now be described with reference to FIGS. 1 to 4. A platen 3, a guide shaft 4 and a guide rail 5 are mounted between side plates 1 and 2 opposed to each other. A carrier 8 for holding a printing head 6 and a ribbon cassette 7 is slidably held by the guide shaft 4 and the guide rail 5.

Figure 4:
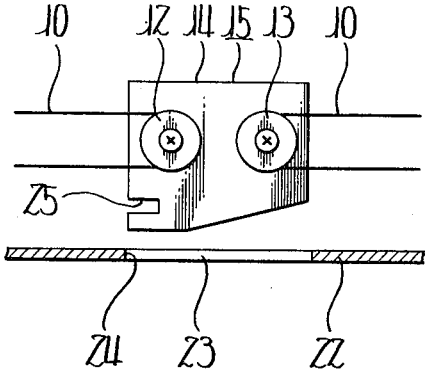
FIG. 4 is a front view showing a part in section of a state in which the carrier is released from its temporary stopping.

A winding drum 11 about which a wire 10 is wound is connected to a motor 9 which can be rotated normally and reversely. A retainer 15 is provided wherein two movable pulleys 12 and 13 are supported on a mounting plate 14. One end of the wire 10 wound about the winding drum 11 is wound about a pulley 16 supported on the side plate 1 and further wound about the movable pulley 12 with the extremity thereof fastened to the side plate 1 by means of a bolt 17 and a nut 18, and the other end of the wire 10 is wound about a pulley 19 supported on the side plate 2 and further wound about the movable pulley 13 with the extremity thereof fastened to a plate spring 20 secured to the side plate 2. The mounting plate 14 of such a wire retainer 15 is mounted on the carrier 8 by means of screws 21. As shown in FIG. 4, a base 22 which is a fixing member opposed to the wire retainer 15 is formed with an opening 23 which is a temporary stopping portion and the mounting plate 14 of the wire retainer 15 is formed with a notch 25 which is a temporary stopping portion in engagement with an edge 24 of the opening 23.

In the structure as described above, when the motor 9 is normally or reversely rotated, the winding drum 11 winds up the wire 10, the carrier 8 and the wire retainer 15 are integrally moved along the platen 3 by tension of the wire 10.

Figure 3:
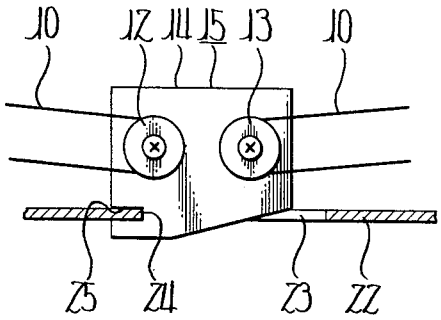
FIG. 3 is a front view showing a part in section of a state in which a carrier is temporarily stopped when a wire is stretched.

Then, when assembled, the wire 10 is wound about the movable pulleys 12 and 13 while pulling the wire. In this case, as shown in FIG. 3, if the notch 25 of the wire retainer 15 is made to engage the edge 24 of the opening 23 and the wire 10 is first placed on the movable pulley 12, it is possible to lock leftward movement of the wire retainer 15 to facilitate operation. After the wire 10 has been stretched, the notch 25 is disengaged from the edge 24 of the opening 23 as shown in FIG. 4. Under this condition, the wire 10 can be maintained in a condition wherein tension is imparted thereto by means of the plate spring 20, and accordingly, when the wire retainer 15 and the carrier 8 are assembled and separated, the wire 10 need not be removed.

Figure 5:
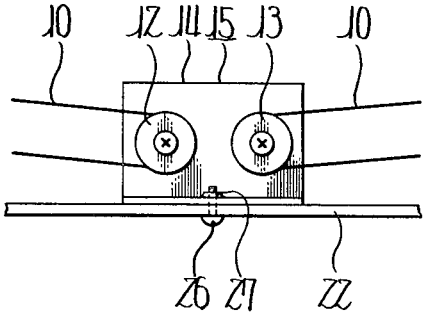
FIG. 5 is a front view of a part showing a modified form of means for temporarily stopping the carrier.

Next, a modified form of means for temporarily stopping the carrier wil be described with reference to FIG. 5. In this modified form, while the wire retainer 15 is temporarily stopped on the base 22 when the wire 10 is stretched, a screw 26 inserted through the base 22 is made to serve as a temporary stopping portion and a tapped hole 27 formed in the mounting plate 14 of the wire retainer 15 is made to serve as a temporary stopping portion. The screw 26 can be threadedly engaged with the tapped hole 27 to temporarily stop the wire retainer 15.

Further, the wire retainer 15 is not limited to one which is provided with the movable pulleys 12 and 13. Both ends of the wire 10 wound about the pulleys 16 and 19 can be directly secured to the mounting plate 14. In this case, a coiled spring or the like can be provided in a route of the wire 10 to impart tension to the wire 10.

Figure 6:
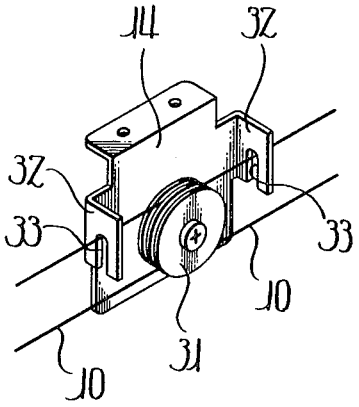
FIG. 6 is a perspective view of a wire retainer showing a second embodiment of the present invention.
Figure 7:
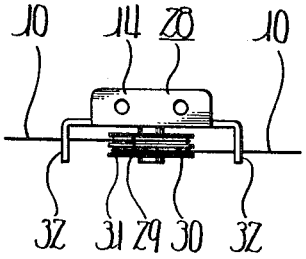
FIG. 7 is a plan view.

Next, a second embodiment of the present invention will be described with reference to FIGS. 6 and 7. Those which are the same parts as the previous embodiment bear the same reference numerals and the description thereof will be omitted. A wire retainer 28 in the second embodiment supports a movable pulley 31 formed with two grooves 29 and 30 in which the wire 10 is wound by varying the winding directions. The wire retainer 28 has bent portions 32 bent at both ends of the mounting plate 14, said bended portions being formed with insert portions 33 in the form of notches. The wire 10 is turned at the grooves 29 and 30 and is passed through the insert portions 33, the wire 10 having one end fastened to the side plate 1 whereas the other end thereof is fastened to the plate spring 20.

Thus, the grooves 29 and 30 are not on one and the same plane and the tension of the wire 10 acts as couple of forces on the mounting plate 14. However, even a state where the carrier 8 is removed from the wire retaining plate 28, the wire 10 is inserted through the insert portions 33 and therefore, the mounting plate 8 is not turned and hence the wire 10 is not disengaged from the grooves 29 and 30.

What is claimed is:

1. A serial printer comprising:

(a) a pair of side plates opposed to each other;

(b) a platen extending between said pair of side plates;

(c) a carrier;

(d) a printing head mounted on said carrier;

(e) first means for slidably mounting said carrier so that said carrier may be reciprocated along said platen;

(f) a wire retainer;

(g) second means for connecting said wire retainer to said carrier, said second means permitting ready detachment of said carrier from said wire retainer;

(h) a motor which can be rotated normally and reversely;

(i) a winding drum driven by said motor;

(j) a wire which is trained over said winding drum and which is connected to said wire retainer such that rotation of said motor while said carrier is attached to said wire retainer causes corresponding movement of said carrier and of said printing head;

(k) a base member which is fixed relative to said side plates; and (l) third means for temporarily fixing said wire retainer to said base member while said carrier is detached from said wire retainer for repair or the like, said third means not requiring that said wire be disconnected from said wire retainer while said carrier is detached from said wire retainer.

2. A serial printer as recited in claim 1 wherein said third means comprise:

(a) an opening in said base member and (b) a notch in said wire retainer which can be selectively brought into engagement with an edge of said opening to temporarily prevent movement of said wire retainer in at least one direction.

3. A serial printer as recited in claim 1 wherein said third means comprise fourth means for detachably connecting said wire retainer to said base member.

4. A serial printer as recited in claim 3 wherein said fourth means comprise a threaded fastener.

5. A serial printer as recited in claim 1 wherein said second means comprise a threaded fastener.

* * * * *